United States Patent [19]

Johnston

[11] Patent Number: 4,494,354

[45] Date of Patent: Jan. 22, 1985

[54] DOOR FRAME CONSTRUCTION

[75] Inventor: James R. Johnston, Sterling, Ill.

[73] Assignee: National Manufacturing Co., Sterling, Ill.

[21] Appl. No.: 458,716

[22] Filed: Jan. 17, 1983

[51] Int. Cl.[3] ..... E04C 2/34

[52] U.S. Cl. ..... 52/814; 52/826; 52/823

[58] Field of Search ..... 52/821, 822, 823–826, 52/814

[56] References Cited

U.S. PATENT DOCUMENTS

| | | | |
|---|---|---|---|
| 2,423,199 | 7/1947 | Milnor | 52/823 |
| 2,755,895 | 7/1956 | Walterman | 52/826 |
| 3,450,426 | 6/1969 | Kellems | 52/826 |
| 3,700,385 | 10/1972 | Sherwood | 52/823 |
| 3,838,548 | 10/1974 | Tanner | 52/823 |
| 3,925,875 | 12/1975 | Doke | 52/241 |
| 4,182,080 | 1/1980 | Naylor | 52/795 |

FOREIGN PATENT DOCUMENTS

| | | | |
|---|---|---|---|
| 258999 | 11/1963 | Australia | 52/823 |
| 647020 | 8/1962 | Canada | 52/823 |
| 1226352 | 3/1971 | United Kingdom | 52/823 |

*Primary Examiner*—Henry E. Raduazo

*Attorney, Agent, or Firm*—Edmond T. Patnaude

[57] ABSTRACT

A door frame is fabricated of rolled sheet metal vertical frame pieces each including a first channel for receiving the end portions of wood or metal horizontal cross-pieces and a second channel for receiving the end portions of corrugated or other panel members, the latter channel being formed by rolling a portion of the sheet metal back on itself to provide a double walled strength portion.

10 Claims, 4 Drawing Figures

DOOR FRAME CONSTRUCTION

The present invention relates in general to metal and part-metal structural frames as used in doors, and it relates in particular to a new and improved frame including vertical frame pieces formed from sheet metal in a rolling operation.

BACKGROUND OF THE INVENTION

U.S. Pat. No. 4,021,988, assigned to the assignee of the present invention describes a door frame construction including vertical channel frame members formed of metal. Doors using that frame construction are particularly suited for on-site construction of large sliding doors of the types used on barns and industrial buildings.

It would be desirable to reduce the weight and manufacturing cost of the vertical frame members without adversely affecting the resistance of the frame to the bending stresses commonly occurring during high wind conditions. Moreover, it would be desirable to improve the resistance of the frame pieces to rust and/or corrosion and to improve the overall appearance of the completed door.

SUMMARY OF THE INVENTION

Briefly, there is provided in accordance with the present invention a novel door construction which includes roll-formed, sheet metal vertical frame pieces each having a first channel in which the end portions of a plurality of horizontal cross pieces are received and a second narrow channel which receives the vertical edge portion of an exterior panel member. During manufacture of the vertical frame pieces, the sheet metal is rolled back on itself in such a way as to provide the narrow channel with a substantially heavier and stronger exterior strengthening flange. Moreover, the external edge of the exterior flange of the narrow channel is a smooth, rolled over section.

In a preferred embodiment of the invention, the sheet metal from which the vertical frame pieces are roll-formed is provided on one side with a rust/corrosion resistant finish such for example, as baked enamel. Upon completion of the door, only the finished side of the sheet metal is exposed on the outside of the door with the double wall outer strenthening flange of the narrow channel providing the flashing for the exterior panel member.

GENERAL DESCRIPTION OF THE DRAWING

The present invention will be better understood by a reading of the following detailed description taken in connection with the accompanying drawing wherein.

Figure 4:
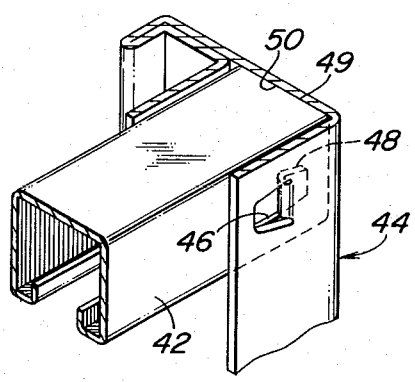
Figure 3:
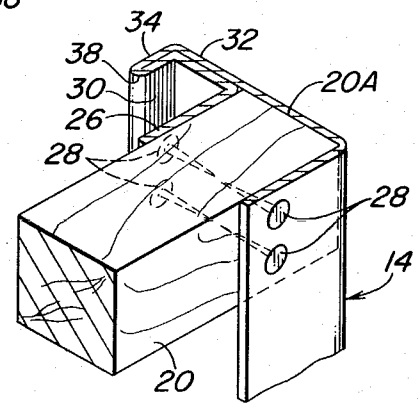

FIG. 3 is a perspective view of the connection between a vertical frame piece and a horizontal crosspiece formed of wood; and FIG. 4 is a perspective view of the connection between a vertical frame piece and a horizontal crosspiece formed of metal, the pieces being secured together by means of integral tabs on the vertical frame piece in the manner described in the said U.S. Pat. No. 4,021,988.

DETAILED DESCRIPTION OF A PREFERRED EMBODIMENT OF THE INVENTION

Figure 1:
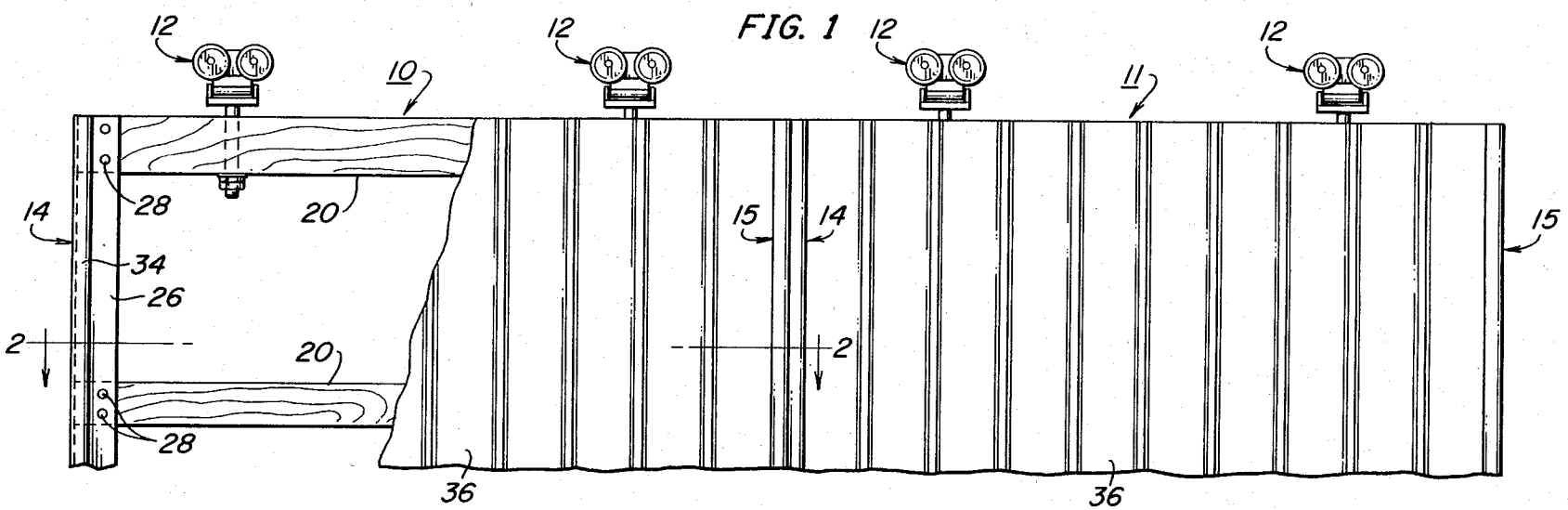
FIG. 1 is a fragmentary, front elevational view of the top portions of a pair of doors embodying the present invention, a portion of the exterior panel of one of the doors being broken away to show a portion of the frame.

Referring particularly to FIG. 1, a pair of identical doors 10 and 11 are each supported for movement between the illustrated closed position and spaced apart open positions by means of a plurality of conventional trolley hangers 12. The trolley hangers are adapted to be carried by a trolley rail, not shown, which is attached to the header which extends across the top of the doorway in which the doors 10 and 11 and disposed.

Figure 2:
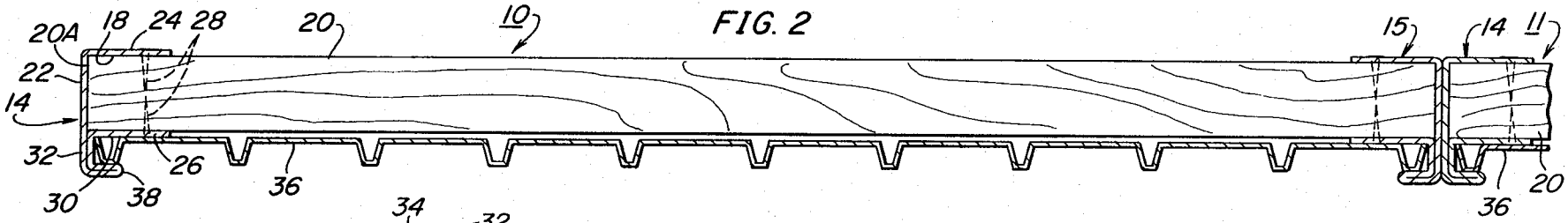
FIG. 2 is a horizontal, sectional view taken along the line 2—2 of FIG. 1.

Referring also to FIG. 2, it may be seen that the doors respectively include two upright or vertical frame pieces 14 and 15. The vertical frame pieces 14 and 15 are identical, and as more fully described hereinafter, are formed from precoated sheet metal in a roll-forming operation. The sheets may be steel or aluminum, and one or both faces may be painted or otherwise treated for improved appearance and rust and/or corrosion resistance. The vertical frame pieces may best be seen in FIG. 2 to include a first channel 18 which receives the respective end portions of a plurality of horizontal crosspieces 20 with the respective end surfaces 20A thereof abutting the base of web 22 of the channel 18. In addition to the web 22 the channel 18 is defined by first and second parallel flanges 24 and 26. A plurality of suitable fasteners such as nails 28 extend through prepunched holes in the vertical frame pieces and fasten the horizontal crosspieces to the vertical frame pieces. Other fastening means such as the integral tabs described hereinafter in connection with FIG. 4 may be used in place of the nails 28.

The frame pieces 14 and 15 also include a shallow, narrow channel 30 defined by the flange 26, a web section 32 and an external flange 34. The channel 30 receives the vertical edge portion of an exterior panel member 36 which, as shown in FIGS. 1 and 2, may be corrugated sheet metal. After the frame has been assembled, the panel member 36 may be slidably moved into the channels 30 of the two frame members from either the top or bottom of the door and suitably secured in place to the horizontal frame members by means of nails or screws. The flange 34 thus provides a flashing on the exterior side of the door and holds the panel member 36 firmly in place against the flange 26 of the vertical frame piece.

The vertical frame pieces 14, 15 may be roll-formed from precut sheet metal stock with the holes for the fasteners 28 being punched in the sheet metal stock prior to the roll-forming operations. The flange 26 is formed of a single thickness of the sheet metal and extends to the very bottom of the channel 18 into contact with the web portion 22 to resist twisting of the crosspieces in the channel 18. The web portion 32 and the flange portion 34 of the channel 30 are formed of a double thickness of the sheet metal stock. Deflection tests conducted on fourteen foot high steel doors have shown that the bending force on the door which causes a failure of the vertical frame pieces is increased by more than fifty-percent by using the double walled strengthening and flashing channel 30.

As shown in FIGS. 2 and 3, the distal edge 38 of the flange 34 is a rolled over intermediate section of the sheet metal whereby there is no sharp external edge exposed to the weather. Moreover, the exposed edge is not rough or sharp as it would be if the distal edge 38 of the flange 34 were an actual edge of the sheet metal stock.

Referring to FIG. 4, there is shown an embodiment of the invention wherein the door frame includes cross frame members 42 in the form of metal channels whose ends extend into vertical frame members 44. The frame members 42 include rectangular openings 46, and tabs 48, which are integral parts of the vertical frame members 44 are rolled under the walls of the members 42 to push the distal edges 49 tightly against the webs 50 of the vertical frame members 50. This method of locking the horizontal and vertical frame members together is more fully described in U.S. Pat. No. 4,021,988.

It may be seen that in the two embodiments of the invention respectively shown in FIGS. 3 and 4, the channels which receive the horizontal cross frame members are complete channels formed by a single thickness of the sheet metal stock. Under inwardly directed wind forces pivoting of the horizontal frame members in the vertical frame members is inhibited by the external strengthening channel.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed:

1. A door frame, comprising in combination first and second vertical frame members each having first and second mutually parallel channels facing toward the other of said vertical frame members, said first channel being defined by a first web portion and first and second rigid side flanges, said second channel being defined by a second web portion, a third rigid side flange and said second rigid side flange, said flanges each having straight mutually parallel inner and outer surfaces perpendicular to said first and second web portions, a plurality of horizontal frame members respectively received in said first channels and disposed against said first webs and said inner surfaces of said first and second flanges, a panel positioned against said horizontal frame members received in said second channel of said vertical frame members and disposed against said inner surface of said flange with its vertical edge portions respectively disposed in said second channels, said second web portion and said third side flange being substantially thicker than said first web portion and said first and second side flanges.

2. A door frame according to claim 1 wherein each of said vertical frame members comprises a roll-formed metal sheet, said sheet being rolled back on itself to form said second web portion and said third flange.

3. A door frame according to claim 2 wherein the distal vertical edge of said third flange is formed at the location wherein said sheet is rolled back on itself.

4. A door frame according to claim 1 wherein said horizontal frame members are made of wood, and a plurality of fasteners extend through openings in said first and second flanges into said horizontal frame members.

5. A door frame according to claim 1 wherein the width of said third flange is substantially less than the respective heights of said first and second flanges.

6. A door frame according to claim 1 wherein said horizontal frame members have openings through the side flanges thereof, comprising integral tabs diecut in said first and second flanges and curled through said openings under said side flanges of said horizontal frame members to fasten said horizontal frame members to said vertical frame members.

7. A door frame according to claim 6 wherein the width of said third flange is substantially less than the respective heights of said first and second flanges.

8. A door frame according to claim 3 wherein the side of said sheet providing the external surfaces of said vertical frame members is treated with a substantially non-corrosive finish before the roll forming operation in which it is formed into said vertical frame member.

9. A door frame according to claim 1 wherein said panel comprises a corrugated metal sheet.

10. A door frame, comprising in combination, first and second vertical frame members, each frame member being a piece of sheet metal rolled formed into first and second mutually parallel channels facing toward the other of said vertical frame members.

said first channel being defined by a first web portion and first and second rigid side flanges having equal thickness, said second channel being defined by a second web portion, a third rigid side flange and said second rigid side flange, said flanges each having straight mutually parallel inner and outer surfaces perpendicular to said first and second web portions, the width of said second web portion being substantially less than the width of said first web portion, and the length of said third flange being substantially less than the length of said first and second flanges, said sheet metal piece being partially rolled back onto itself forming said third flange and said second web portion substantially thicker than said first and second flanges and said first web, a plurality of horizontal frame members respectively received in said first channels and disposed against said first webs and said inner surfaces of said first and second flanges, a panel positioned against said horizontal frame members received in said second channels of said vertical frame members and disposed against said inner surfaces of said third flanges and said outer surfaces of said second flanges with its vertical edge portions respectfully disposed in said second channels.

* * * * *